United States Patent [19]

Murakami et al.

[11] Patent Number: 4,495,855

[45] Date of Patent: Jan. 29, 1985

[54] RECIPROCATING TYPE OIL-FREE GAS COMPRESSOR

[75] Inventors: Muneo Murakami, Nishinomiya; Zentaro Ishizaki, Kamakura, both of Japan

[73] Assignees: Showa Precision Machinery Co., Ltd., Amagasaki; Kabushiki Kaisha Ecti Kenkyusho, Kamakura, both of Japan

[21] Appl. No.: 562,242

[22] Filed: Dec. 9, 1983

[30] Foreign Application Priority Data

May 31, 1983 [JP] Japan ..... 58-97520

[51] Int. Cl.[3] ..... F01B 3/02

[52] U.S. Cl. ..... 92/71; 417/269; 92/168

[58] Field of Search ..... 92/71, 70, 168 R; 91/499; 74/18.1; 417/269

[56] References Cited

U.S. PATENT DOCUMENTS

| | | | |
|---|---|---|---|
| 1,631,356 | 6/1927 | Banning Jr. | 74/18.1 |
| 2,570,698 | 10/1951 | Nianseou | 417/269 |
| 3,958,901 | 5/1976 | Drevet | 417/269 |
| 4,235,116 | 11/1980 | Meiger | 417/269 |

FOREIGN PATENT DOCUMENTS

| | | | |
|---|---|---|---|
| WO81/01318 | 5/1981 | PCT Int'l Appl. | 74/18.1 |

*Primary Examiner*—Paul E. Maslousky

*Attorney, Agent, or Firm*—Millen & White

[57] ABSTRACT

In an oil-free multistage gas compressor comprising cylinders, a plurality of compression pistons in respective cylinders and a transmission mechanism for reciprocating said compression pistons through guide pistons serially connected to said compression pistons, the improvement wherein a common space where these pistons come in and out is defined adjacent the connections, and a diaphragm is disposed in said space transversely whereby said compression pistons are oil-tightly separated from said guide pistons.

4 Claims, 2 Drawing Figures

RECIPROCATING TYPE OIL-FREE GAS COMPRESSOR

BACKGROUND OF THE INVENTION

The present invention relates to a reciprocating type oil-free gas compressor.

Generally, reciprocating compressors use lubricating oil between the piston and the cylinder, but where a gas compressor is used as a helium compressor for use with a helium liquefying apparatus, it is required that no lubricating oil be used, since if helium is contaminated with lubricating oil, this would result in icing, which is undesirable from the standpoint of production of cryogenic temperatures. Such gas compressor is generally called the oil-free gas compressor.

For prevention of oil creep-up, conventional oil-free gas compressors use a rod packing installed on the piston rod reciprocated by a cross head or the like or use other oil creep-up preventer, thereby preventing the lubricating oil from creeping up the piston rod into the cylinder to contaminate, e.g., helium gas.

Conventionally, where helium or other expensive gas is to be compressed, another cylinder or a chamber called the distance room is interposed between the cylinder in which the piston is reciprocated and the crank chamber in which the cross head for reciprocating the piston is housed, so that the gas leaking from the cylinder is recovered in such chamber, thereby preventing the gas from leaking out of the compressor.

For example, a conventional gas compressor having a rod packing is as schematically shown in FIG. 1. A piston rod 2 for reciprocating a piston 1 is connected at its lower end to a cross head 5 through a rod packing 3 of Teflon or graphite carbon and an oil seal 4. The space between the rod packing 3 and the oil seal 4 defines a distance room 6. The rod packing 3 comprises a plurality of packing rings 9 housed in a packing box 7 and held by a packing gland 8. In addition, the numeral 10 denotes a crank rod which performs a crank motion. Thus, the movement of the crank rod 10 causes a vertical reciprocating movement of the cross head 5, which, in turn, causes a reciprocating movement of the piston through the intermediary of the piston rod 2, thereby compressing the gas in the cylinder. The lubricating oil in mist form fills the cylinder almost up to the oil seal 4, but it is blocked by the oil seal 4 and the oil adhered to the piston rod 2 is thrown away by the rod packing 3, so that no oil creeps up to the back of the piston 1.

Thus, the conventional reciprocating type oil-free gas compressor employs a construction using a large number of parts for prevention of oil creep-up, and furthermore, some amount of gas is leaking from the back of the piston into the distance room 6. As for the leakage gas, there is no alternative but to recover it by a special recovering device or to let it out into the atmosphere. Thus, there has been much to worry about measures against leakage gas.

Accordingly, an object of the present invention is to provide an oil-free gas compressor simple in construction and capable of recovering leakage gas from the piston without allowing said gas to mix with the lubricating oil, thereby solving the problems with the prior art.

Another object of the invention is to prevent leakage of gas from the compression piston to avoid economic loss.

A further object of the invention is to provide an arrangement wherein a piston and a guide piston are oil-tightly separated from each other by a single diaphragm while giving a minimum of tension to said diaphragm.

DESCRIPTION OF THE PREFERRED EMBODIMENT

Figure 1:
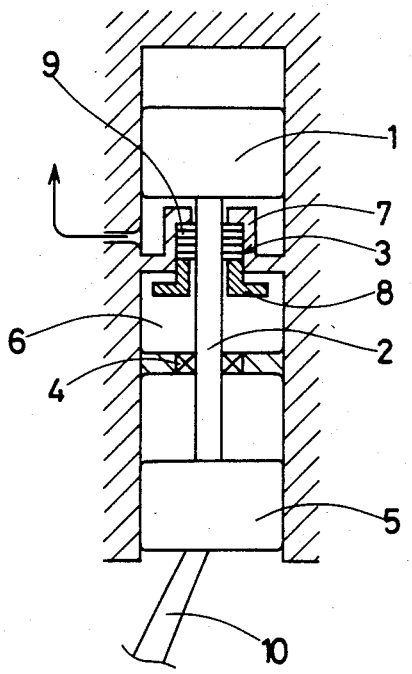
FIG. 1 is a schematic sectional view of a conventional example.
Figure 2:
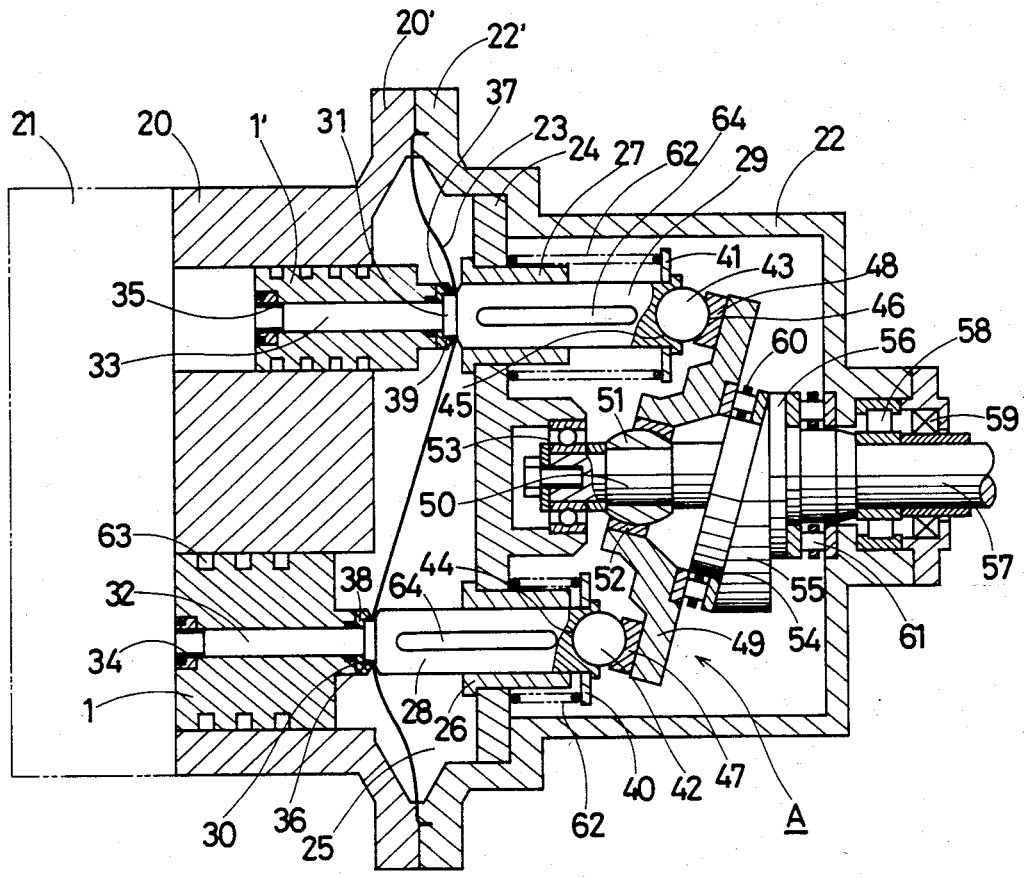
FIG. 2 is a sectional view of an embodiment of the present invention.

FIG. 2 is a sectional view of an embodiment of the invention, showing a 3-cylinder small-sized gas compressor having guide pistons using a wobble plate. However, the second stage piston is not shown.

The numeral 1 denotes a first stage piston called a compression piston; 1' denotes a third stage piston called a compression piston smaller in diameter than the piston 1; 20 denotes a compressor body, i.e., cylinder block bored to provide cylinders; 21 denotes a cylinder head, details of which are omitted; and 22 denotes a transmission case. The compressor body 26 and the transmission case 22 hold the outer periphery of a single diaphragm 23 therebetween and are clamped together at their flanges 20' and 22' by unillustrated bolts. A support frame plate 24 installed in an intermediate region of the transmission case 22 cooperates with said diaphragm 23 to define a distance room 25, there being also defined a common space where the pistons 1 and 1' come in and out.

The support frame plate 24 supports guide pistons 28 and 29 through bushings 26 and 27. These guide piston 28 and 29 are removably connected to said pistons 1 and 1' in the following manner: The guide pistons 28 and 29 are formed at their tops with cylindrical portions 30 and 31 from which integrally extend piston rods 32 and 33 which are inserted into said pistons 1 and 1', and at the ends of said rods 32 and 33, i.e., at the tops of the pistons 1 and 1', the pistons 1 and 1' are fixed to the piston rods 32 and 33 by lock nuts 34 and 35. In this connection, before the piston rods 32 and 33 are inserted into the pistons 1 and 1', holes 36 and 37 formed in said diaphragm 23 are elastically enlarged and fitted on the cylindrical portions 30 and 31 and then the diaphragm 23 is lightly pressed against the tops of the guide pistons 28 and 29 by keep collars 38 and 39. Thereafter, the piston rods 32 and 33 are inserted into the pistons 1 and 1' and the lock nuts 34 and 35 are applied to connect the pistons 1, 1', diaphragm 23 and guide pistons 28 and 29 in a unit. The outer peripheral edges of said keep collars 38 and 39 and guide pistons 28 and 29 contacting the diaphragm 23 are rounded to prevent damage to the diaphragm 23.

The ends of said guide pistons 28 and 29 opposite to the pistons 1 and 1' have spring seats 40 and 41 fixed thereon, and their outer ends are formed with semi-spherical recesses 44 and 45 for receiving balls 42 and 43.

The reciprocating movement of the guide pistons 28 and 29 will now be described using a known axial type reciprocating mechanism A.

The balls 42 and 43 are further held at the other sides thereof by slippers 47 and 48 each having a recess 46 of semi-circular cross-section, the other surfaces of said slippers 47 and 48 being in slidable surface contact with one surface of a wobble plate 49. Thus, it follows that said wabble plate 49 and said guide pistons 28 and 29 are interconnected by a ball joint mechanism comprising the balls 42 and 43 and slippers 47 and 48.

A short drive shaft 50 is rotatably inserted into the central region of said wobble plate 49, through a ball socket 51 and ball retainer 52. Therefore, the wobble plate 49 is supported on said short drive shaft 50 by a ball joint mechanism comprising the ball socket 51 and ball retainer 52. One end of said short drive shaft 50 is supported by a bearing 53 in the central region of said support frame plate 24 and the other end is connected to a drive shaft 57 through a triangular plate 55 and a flange 56. The drive shaft 57 is supported in the aforesaid transmission case 22 by a roller bearing 58 and an oil seal 59 and is driven by an electric motor (not shown).

A bearing spigot 54 lathed out of the triangular plate 55 and a bearing socket formed in said wobble plate 49 have fitted thereto the inner and outer races of a thrust roller bearing 60, whereby the thrust produced by the rotation of said triangular plate 55 is transmitted to said wobble plate 49 to swing the latter. The reaction from said thrust is supported by said flange 56, thrust roller bearing 61 and transmission case 22.

In addition, the numeral 62 denotes return springs for the guide pistons 28 and 29; 63 denotes piston rings of Teflon; and 64 denotes rotation-preventive keys installed in the guide pistons 28 and 29.

Since the present embodiment is arranged in the manner described above, the rotation of the drive shaft 57 causes the guide pistons 28 and 29 to alternately reciprocated through the mechanical movement of the axial type plunger reciprocating mechanism A. The reciprocating movement of the guide pistons 28 and 29 causes the pistons 1 and 1' to alternately reciprocate so as to compress the gas in the cylinders. The transmission case 22 has a sufficient amount of lubricating oil injected thereinto to ensure a smooth movement of said reciprocating mechanism A.

Even when the guide pistons 28 and 29 and hence the pistons 1 and 1' are reciprocated, the diaphragm 23 follows this movement by only being bent and hence even if the lubricating oil creeps up the guide pistons 28 and 29 into the distance room 25, it is shut off from the cylinders. Further, the gas leaking from the piston rings 63 for the pistons 1 and 1' to the backs of the pistons is prevented from entering the distance room 25, so that it does not mix with the lubricating oil. In addition, the leakage gas is suitably recovered and collected in the suction ports for the pistons, through not shown.

In the present embodiment, the reciprocating movement of the guide pistons 28 and 29 has been described as effected by an axial type plunger reciprocating mechanism, but a crank cross head mechanism may be used. The invention is not limited to such embodiment, and it goes without saying that the guide pistons in the present invention, besides being those shown in the embodiment, may be cross heads or simply piston rods.

In brief, the present invention is, in a multistage gas compressor in which cylinders having a plurality of compression pistons are connected to a transmission case, an oil-free gas compressor characterized in that guide pistons for imparting reciprocating movements to these compression pistons are respectively connected in series to said compression pistons, a common space where these pistons come in and out is defined adjacent the connections, and a single diaphragm is installed in said space, said diaphragm oil-tightly separating said compression pistons from said guide pistons. Thus, the invention has the following effects.

(1) Since there is no lubricating oil creeping up into the compression piston chamber owing to the guide pistons, there is no possibility of compressed gas being contaminated with the lubricating oil.

(2) Since the leakage from the compression pistons does not enter the guide piston reciprocating mechanism chamber, i.e., the transmission case, there is no economic loss due to leakage of gas.

(3) Since a single diaphragm is enough to cut off lubricating oil or leakage gas, it is possible to provide a gas compressor which is simple in construction, inexpensive and compact.

(4) Since a single diaphragm is installed in a common space where the pistons come in and out, as compared with an arrangement using a diaphragm for each piston, the diaphragm clamping portion and the connection between the cylinders and the transmission case can be omitted and the center distance between the cylinders for the pistons can be reduced, so that a small-sized compact gas compressor can be obtained.

(5) Since a single diaphragm is installed in a common space where the pistons come in and out, the area necessary for retaining the durability of the diaphragm is advantageously made smaller than in the case where a diaphragm is provided for each piston, with the result that an inexpensive, small-sized compact gas compressor can be provided.

(6) Since a single diaphragm is installed in a common space where the pistons come in and out and since the pistons come in and out alternately, there is no possibility of the back pressure due to the reciprocating movement of the pistons imparting tension to the diaphragm, nor is the possibility of imposing an excessive load on the diaphragm.

What is claimed is:

1. In a multistage gas compressor in which cylinders having a plurality of compression pistons are connected to a transmission case, an oil-free gas compressor characterized in that guide pistons for imparting reciprocating movements to these compression pistons are respectively connected in series to said compression pistons, a common space where these pistons come in and out is defined adjacent the connections, and a single diaphragm is installed in said space, said diaphragm oil-tightly separating said compression pistons from said guide pistons.

2. A reciprocating type oil-free gas compressor as set forth in claim 1, wherein the outer periphery of the diaphragm is clamped between flanges of the cylinder block and transmission case.

3. A reciprocating type oil-free gas compressor as set forth in claim 1, wherein a hole formed in the diaphragm is elastically enlarged and fitted on a cylindrical portion formed on a top of a guide piston.

4. A reciprocating type oil-free gas compressor as set forth in claim 1, wherein a hole formed in the diaphragm is elastically enlarged and fitted on a cylindrical portion formed on a top of a guide piston and said diaphragm is pressed against the guide piston top by a keep collar, and wherein portions of said keep collar and guide piston top contacting the diaphragm are rounded.

* * * * *